US006941889B1

(12) United States Patent
McCrocklin et al.

(10) Patent No.: US 6,941,889 B1
(45) Date of Patent: Sep. 13, 2005

(54) APPARATUS AND METHOD FOR BOARDING ANIMALS INTO A BOAT

(76) Inventors: Amber McCrocklin, 10285 Lakeland Dr., Fishers, IN (US) 46038; John Niehaus, 1105 Westfield Ct. West, Apt. K, Indianapolis, IN (US) 46220

( * ) Notice: Subject to any disclaimer, the term of this patent is extended or adjusted under 35 U.S.C. 154(b) by 29 days.

(21) Appl. No.: 10/772,193

(22) Filed: Feb. 4, 2004

(51) Int. Cl.[7] ..... B63B 17/00
(52) U.S. Cl. ..... 114/362; 182/95
(58) Field of Search ..... 182/83, 93, 95, 182/96, 120, 121, 124, 125; 114/362; 119/706; 14/69.5; D30/119

(56) References Cited

U.S. PATENT DOCUMENTS

| | | | | | |
|---|---|---|---|---|---|
| 362,747 | A * | 5/1887 | Higgins | 248/237 |
| 1,352,914 | A * | 9/1920 | Plasclascovitie | 182/121 |
| 3,294,197 | A * | 12/1966 | Kwiatkowski | 182/120 |
| 4,538,314 | A * | 9/1985 | Baranowski | 14/71.1 |
| 4,611,552 | A * | 9/1986 | Koppelomaki | 114/343 |
| 4,618,030 | A * | 10/1986 | Campbell | 182/121 |
| 4,696,373 | A * | 9/1987 | Page | 182/121 |
| 5,158,023 | A * | 10/1992 | Allen | 108/42 |
| D440,717 | S * | 4/2001 | Fazio | D30/119 |
| 6,598,562 | B1 * | 7/2003 | Dutkiewicz et al. | 119/706 |
| 2003/0106173 | A1 * | 6/2003 | Miller | 14/71.1 |

* cited by examiner

*Primary Examiner*—Andrew D. Wright
(74) *Attorney, Agent, or Firm*—Bingham McHale LLP; C. John Brannon; Daniel L. Boots

(57) ABSTRACT

An assembly for boarding swimming animals into a boat having a boat ladder, and having an elongated ramp with a sidewall. A plurality of apertures is formed through the sidewall, and a connection assembly is connected to the ramp. The connection assembly includes a cross member, at least one hooked support member extending therefrom for engaging the boat ladder, at least one pivotable grip member pivotingly connected to the hooked support member, a biasing member operationally connected to the pivotable grip member to urge the pivotable grip member in a first direction, and an elongated lanyard member operationally connected to the pivotable grip member. A positioning assembly is to the ramp for positioning the ramp relative the boat ladder and may be connected to the ramp through any desired apertures.

16 Claims, 7 Drawing Sheets

APPARATUS AND METHOD FOR BOARDING ANIMALS INTO A BOAT

BACKGROUND OF THE INVENTION

Pet owners frequently enjoy taking their animals along with them on recreational excursions. Sometimes, the animals even play a specific role in the recreation, such as hunting dogs that retrieve birds; other times, the animals are merely along for the ride. In either case, pet owners occasionally find themselves accompanied by their animals on boat rides, and the animals likewise occasionally find themselves in the water. Most animals have a great deal more difficulty transitioning from the water back into the boat than the other way around, and require assistance in their efforts to get back into the boat. Usually, this means a person (either the pet owner or an exceptionally generous good sport) has to lean into the water, grab the (often struggling) animal, and hoist the now-soaking-wet animal into the boat. As might be imagined, the retrieval process is awkward, cumbersome, messy and wet.

There are currently several known ladder and/or ramp devices for allowing animals to reboard a boat under their own power and without human assistance. These include devices described in prior art patents such as U.S. Pat. No. 3,891,053 to Burton, U.S. Pat. No. 4,538,314 to Baranowski, U.S. Pat. No. 4,724,925 to Ritten and U.S. Pat. No. 5,592,801 to Balzer. These designs, while advances over the above-described reboarding technique, all suffer from the drawbacks of being overly bulky, complicated, difficult to attach and detach to/from the boat, and/or not universally adaptable to different boat designs. Thus, there remains a need for a mechanism for facilitating animal travel between the boat and the water that is easily carried and readily attached to most boat designs.

SUMMARY OF THE INVENTION

The present invention relates to a device for attachment to a boat for boarding animals thereinto. The device includes an elongated ramp member having a proximal end portion and a central body portion, a support member extending from the proximal end and engagedly abutting a first portion of the boat extending above-the-waterline, a strut extending from the central portion and abutting a second portion of the boat extending below-the waterline, and a gripping assembly connected to the support member for releasably engaging the boat.

One object of the present invention is to provide an improved system for transporting animals between a boat and the water. Related objects and advantages of the present invention will be evident from the following descriptions.

DETAILED DESCRIPTION OF THE PREFERRED EMBODIMENTS

Figure 1:
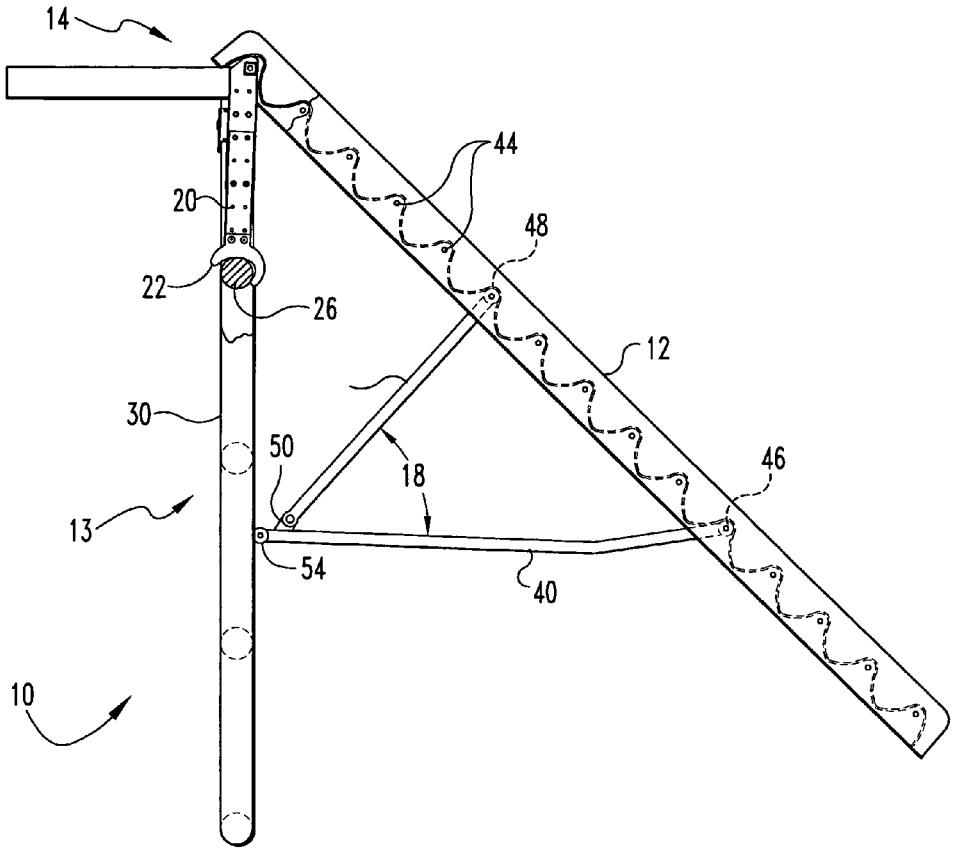
FIG. 1 is a side plan view of a first embodiment of the apparatus of the present invention engaged to a boat ladder.

For the purposes of promoting an understanding of the principles of the invention and presenting its currently understood best mode of operation, reference will now be made to the embodiments illustrated in the drawings and specific language will be used to describe the same. It will nevertheless be understood that no limitation of the scope of the invention is thereby intended, with such alterations and further modifications in the illustrated device and such further applications of the principles of the invention as illustrated therein being contemplated as would normally occur to one skilled in the art to which the invention relates.

FIGS. 1–6 illustrate a first preferred embodiment of the present invention, a boat boarding device 10 for facilitating the boarding of a boat by ambulatory animals, such as dogs or cats, from the water into a boat. The device 10 includes an elongated ramp or ladder member 12 connectable to a boat ladder 13 via a support assembly 14 connected to the ramp member 12 near one end (for convenience, designated the proximal end of the ramp member 12.) Specifically, the support assembly 14 includes a connection assembly 16 for engaging the device 10 to the boat ladder 13. For convenience, the device further includes a positioning or strut assembly 18 extendable from the ramp member 12 to engage the boat ladder 13 or other fixture of a boat to determine the angle between the boat ladder 13 and the ramp member 12. The ramp member 12 preferably includes a plurality of stair-steps 15 formed therein, and the stair steps 15 more preferably have slightly concave surfaces, such that even when the ramp member 12 is deployed at a relatively steep angle, an animal traversing the ramp member 12 will enjoy maximized stability of footing.

Figure 3:
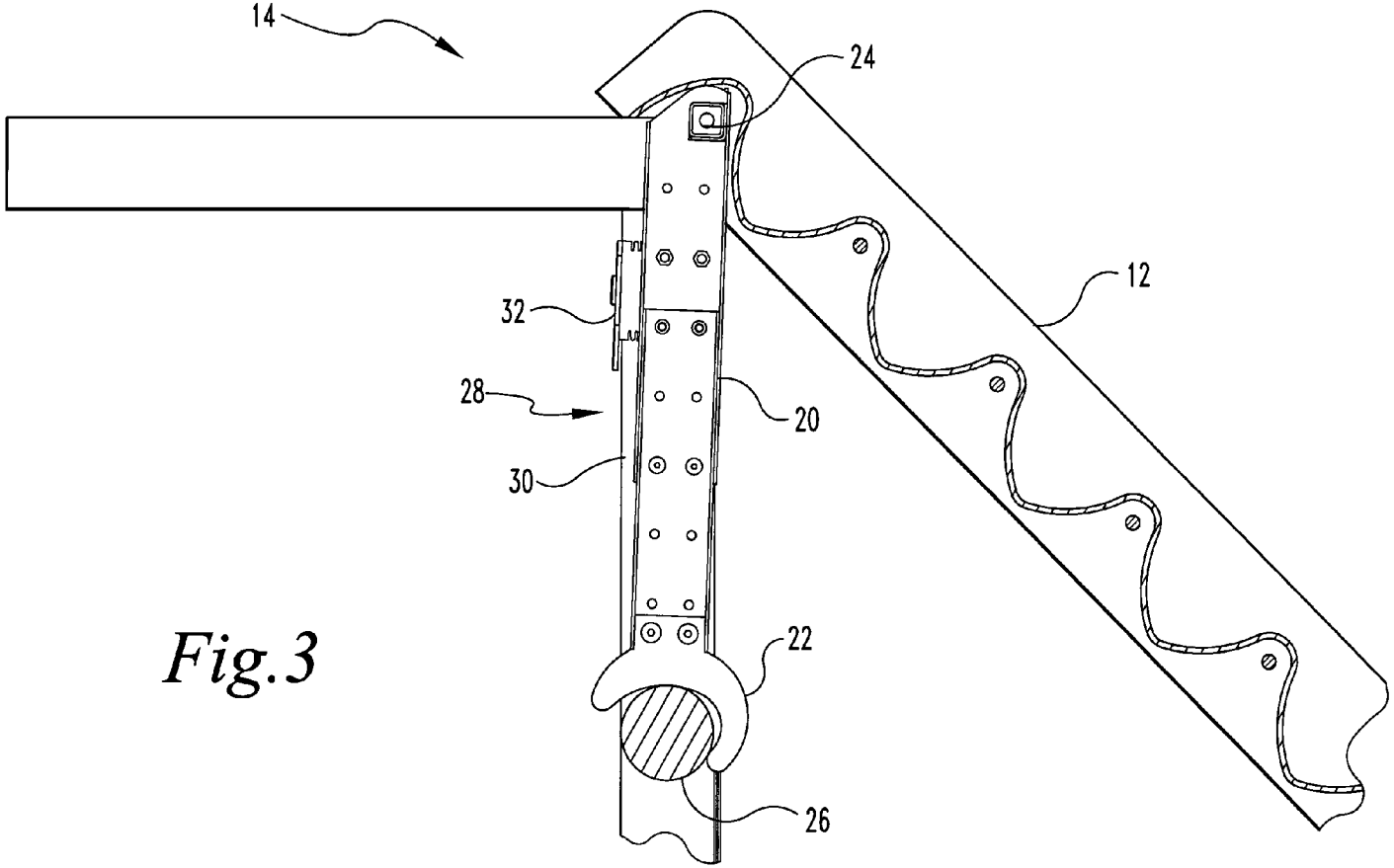
FIG. 3 is an enlarged partial view of the top portion of the embodiment of FIG. 1.
Figure 4:
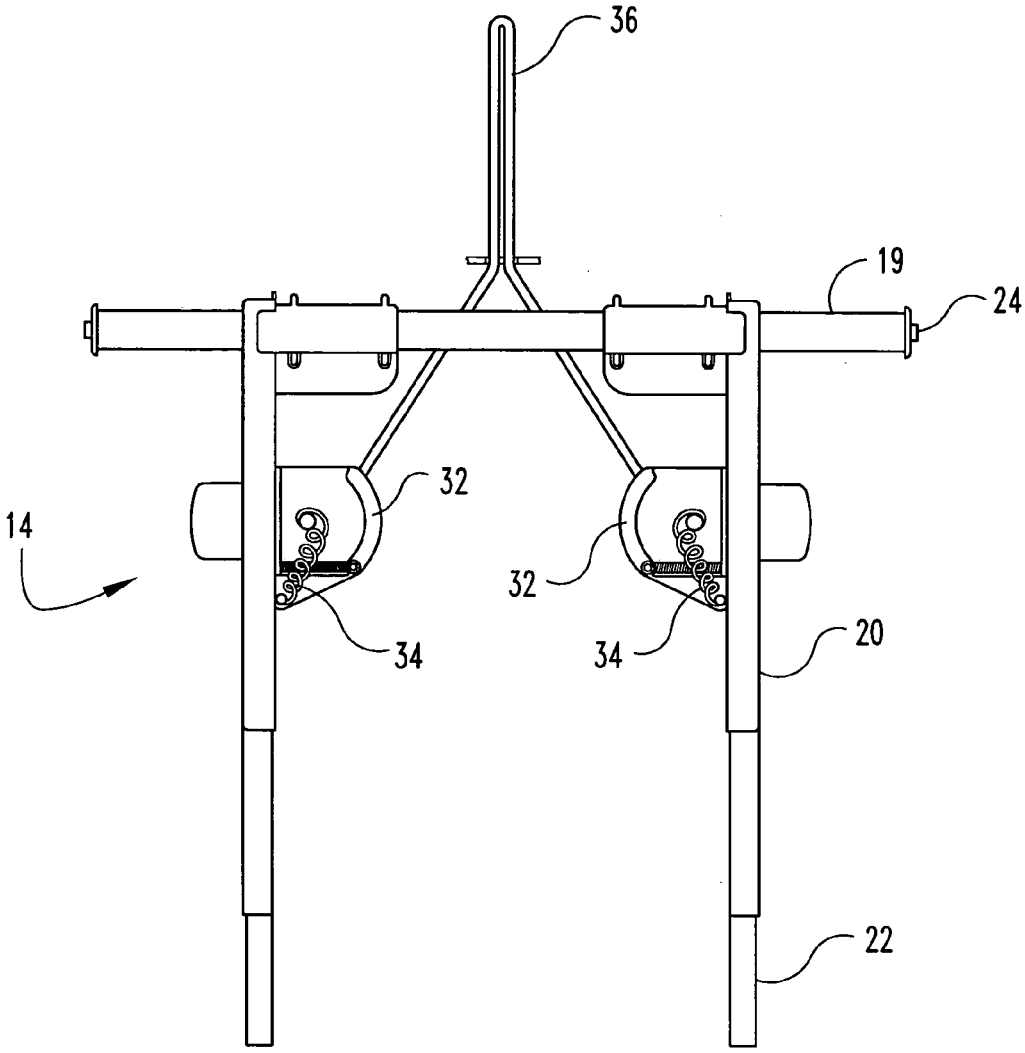
FIG. 4 is schematic view of the support assembly of the embodiment of FIG. 1.

FIGS. 3 and 4 illustrate the support assembly 14 is greater detail. The support assembly 14 includes a crossbeam 19 from which at least one, and more preferably two, hooked support members 20 depend. The support members 20 are preferably pivotally connected and more preferably slidingly connected at one end to the crossbeam 19 and terminate in a (preferably C-shaped) hook member 22 at the other end. The support members 20 may thus pivot relative the crossbeam 19 as well as slide along the length of the crossbeam 19. By slidingly positioning the support members 20, the connection assembly 16 may be adjusted to fit boat ladders 13 of a continuum of widths and sizes. In one contemplated embodiment, the connection assembly 16 further includes sliding position markers or stops (not shown) for indicating a preferred position to which the support members 20 should be moved along the crossbeam 19 for engaging a preferred boat ladder 13. The hook member 22 is preferably sized to engagingly receive a top ladder rung 26, i.e. a cylinder with a diameter ranging from about ¾ to about 3 inches. The support assembly 14 is preferably connected to the ramp member 12 by pivoting connection pin 24 extending through an aperture in the ramp member 12. Alternately, the support assembly 14 may be connected to the ramp via any convenient means, such as through the engagement of the ends of the crossbeam 19 into cavities formed in the ramp 12 member to engagingly receive the crossbeam, or the like.

The support assembly 14 further includes a connection assembly 16 for engaging the device 10 to a boat ladder frame 30. The connection assembly 16 includes at least one, and more preferably two, pivotable gripping members 32 coupled to the respective support members 20. A first biasing member 34 is operationally connected between the support member 20 and the gripping member 32 to urge the gripping member 32 to move or pivot in a first direction (preferably to orient the gripping member substantially perpendicular to the support member 20.) In other words, the first biasing member 34 functions to extend the gripping member 32 outwardly away from the support member 20, such that when the device 10 and connection assembly 16 is positioned against a ladder frame 30, the respective gripping members 32 extend behind the ladder frame 30 to wedgingly connect the device 10 to the frame 30. Pivoting a respective gripping members 32 in the first direction thus position the ladder frame 30 generally between the respective gripping member 32 and the support member 20 to wedge or affix the device 10 to the boat ladder 13.

The connection assembly 16 further includes a second biasing member 36 connected to each respective gripping member 32, such that actuation of the second biasing member 36 urges the respective gripping member 32 to move or pivot in a second direction opposite the first direction. Thus, actuation of the second biasing member 36 urges the gripping member 32 to release an engaged ladder 13 portion and actuates removal of the device 10 from the ladder 13. Preferably, the second gripping member 32 is a flexible connector, such as a lanyard member, connected to each respective second biasing member 36 and extending away therefrom. Movement of the lanyard member 36 away from the gripping member(s) 32 thus actuates their movement in the second direction.

Figure 2:
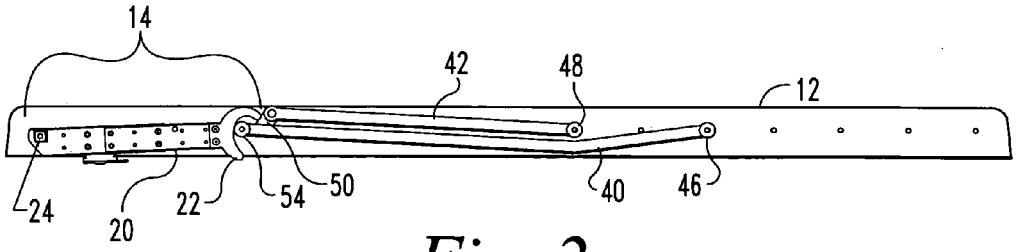
FIG. 2 is a side cutaway view of the apparatus of FIG. 1.
Figure 5:
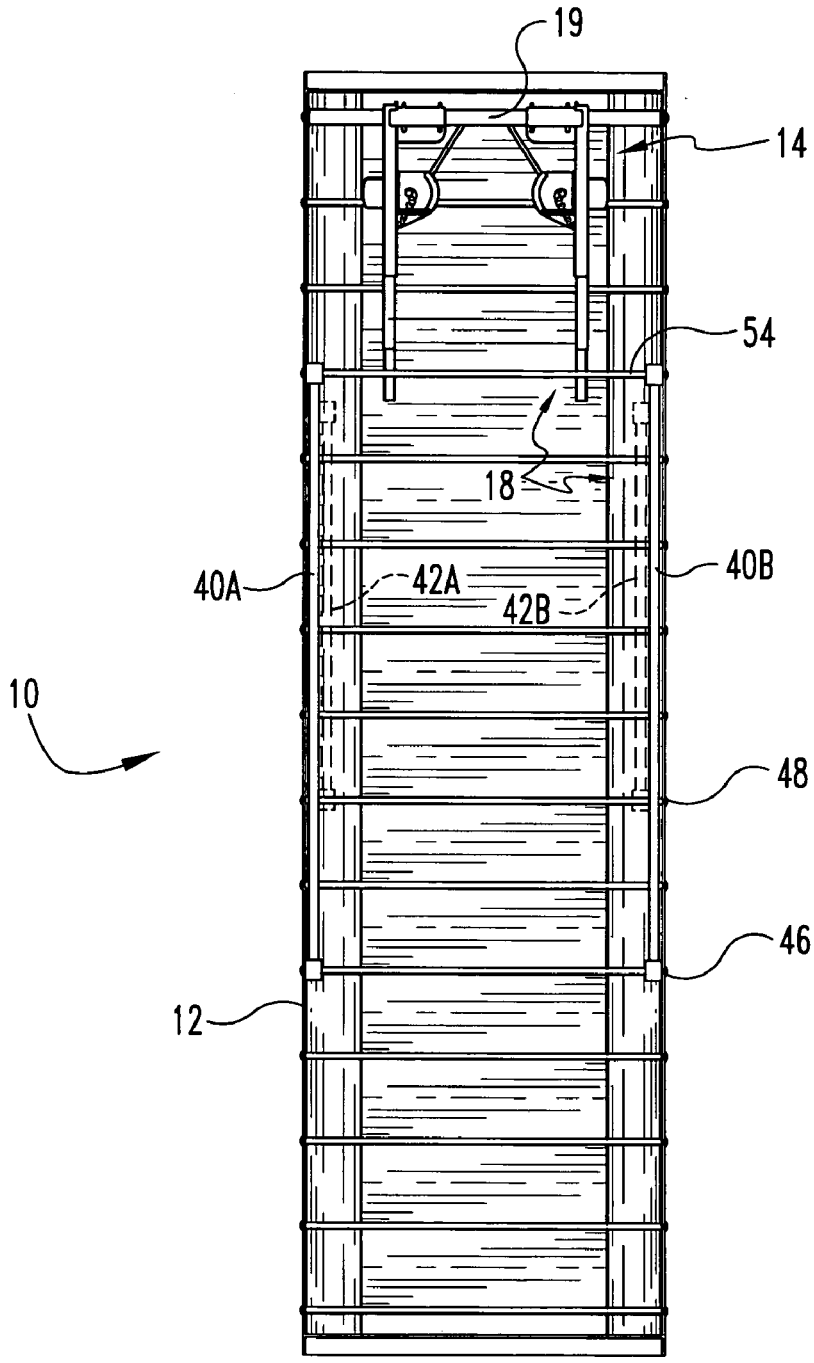
FIG. 5 is bottom plan view of the embodiment of FIG. 1.
Figure 6:
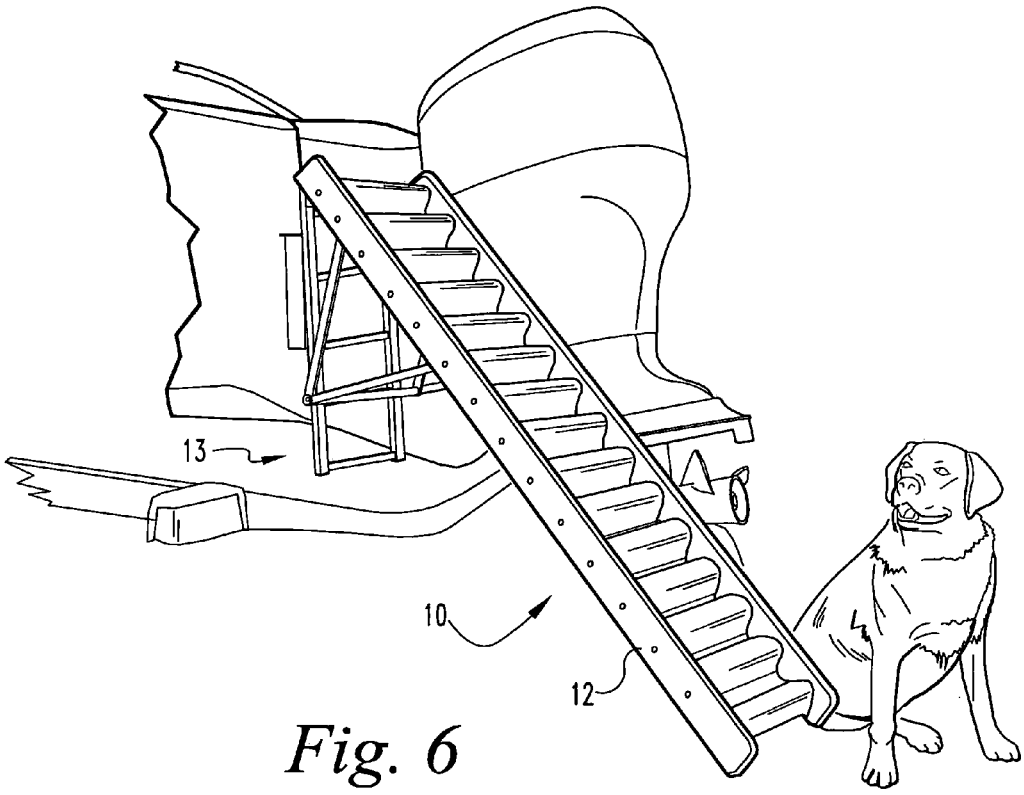
FIG. 6 is a perspective view of the embodiment of FIG. 1.

As illustrated in greater detail in FIGS. 1, 2 and 5, the device 10 also includes a positioning or strut assembly 18 for defining the contact angle between the ramp member 12 and the boat (and/or boat ladder 13.) The strut assembly 18 includes a first elongated strut 40 and a second elongated strut 42, each respective strut 40, 42 independently connectable to the ramp member 12 via a plurality of spaced apertures 44 formed therethrough. The first and second struts 40, 42 each include a respective first and second pivotable connecting pin 46, 48 extending from one end (for convenience, the proximal end), and are preferably joined at their respective other ends (for convenience, the distal ends) by a coupling connector 50. The coupling connector 50 is preferably a pivoting connector, such that the struts 40, 42 may be moved relative each other through a continuum of angles. Engagement of the struts 40, 42 to the ramp member 12 via insertion of the respective pins 46, 48 each into a respective one of the plurality of apertures 44 generally defines a triangle with a respective strut 40, 42 and the ramp member 12 each comprising a side. The selection of the position of the apertures 44 into which the pins 46, 48 are inserted determined the internal angles of the triangle, which in turn determines the angle between the ramp member 12 and the boat ladder 13. One of the struts 40, 42 (preferably the first elongated strut 40) further includes an elongated boat ladder-engaging member 54 connected to its distal end and oriented perpendicular thereto to abutingly engage the boat ladder from when the connecting assembly 16 is engaged thereto and the struts 40, 42 are engaged to the ramp member 12.

Preferably, as seen in FIG. 5, each elongated strut member 40, 42 further comprises a pair of substantially identical elongated struts/positioning members 40A–B, 42A–B. More preferably, boat ladder engaging member 54 extends between the first pair of elongated positioning members 40A–B.

In operation, the device 10 is connected to a boat (preferably to a boat ladder 13) by pivoting the gripping members 32 in the second direction, positioning the connection assembly 16 adjacent the boat ladder 13 such that the hooked member 22 abutingly receives the top rung 26 of the boat ladder 13 and the ladder frame 30 is adjacent the support member 20. The gripping member 32 is then pivoted in the first direction such that the ladder frame 30 is snugly engaged between the gripping member 32 and the support member 20.

The angle defined between the ramp member 12 and the boat ladder 13 (and, more generally, the boat) is determined by the selection of apertures 44 into which pins 46, 48 are inserted. If pins 46, 48 are inserted into apertures 44 spaced relatively close together, the angle between the ramp member 12 and the boat ladder 13 will be relatively great (and, conversely, the ramp member 12 will extend below the horizontal waterline at a relatively shallow angle;) if pins 46, 48 are inserted into apertures spaced relatively far apart, the angle between the ramp member 12 and the boat ladder 13 will be relatively small (and, conversely, the ramp member 12 will extend below the horizontal waterline at a relatively steep angle.) Likewise, if the positions of the apertures 44 into which pins 46, 48 are inserted are relatively close to the proximal end of the ramp member 12, the angle between the ramp member 12 and the boat ladder 13 will be relatively great (and, conversely, the ramp member will extend below the horizontal waterline at a relatively shallow angle;) if pins 46, 48 are inserted into apertures spaced relatively far from the proximal end of the ramp member 12, the angle between the ramp member 12 and the boat ladder 13 will be relatively small (and, conversely, the ramp member 12 will extend below the horizontal waterline at a relatively steep angle.) The support member 20 typically engages a portion of the boat ladder 13 (and, more generally, the boat) that is above the waterline and holds a portion of the ramp member 12 likewise above the waterline, while the rest of the ramp member 12, as well as the rest of the boat ladder 13 (and, more generally, the boat) extends below the waterline.

The device 10 is removed from engagement with the boat ladder 13 by pivoting the gripping members 32 in the second direction to release the boat ladder 13 (or whatever fixture of the boat the device 10 is engaged to.) This is accomplished by actuating the second biasing member(s) 32 to urge the gripping member(s) to pivot in the second direction. In the preferred embodiment, the gripping member(s) 32 is/are pivoted in the second direction by exerting a force on the second biasing member 36 to move the second biasing member 36 in a direction away from the gripping member(s) 32, thus transmitting a force onto the gripping member(s) 32 urging pivoting in the second direction. Once disengaged, the device 10 may be folded relatively flat (as shown in FIG. 2) for transport and storage.

Figure 7A:
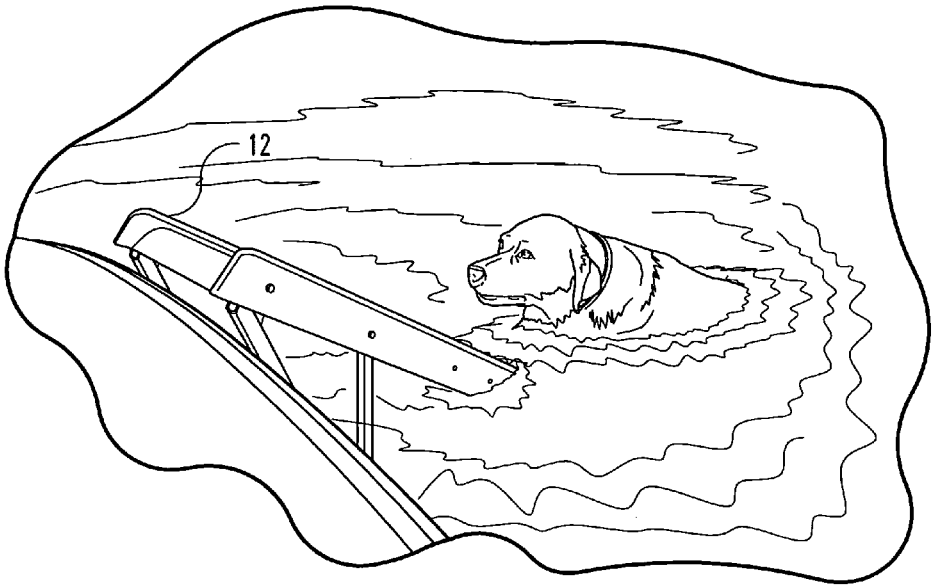
FIG. 7A is first perspective view of a dog beginning to use the embodiment of FIG. 1 to board a boat from the water.
Figure 7B:
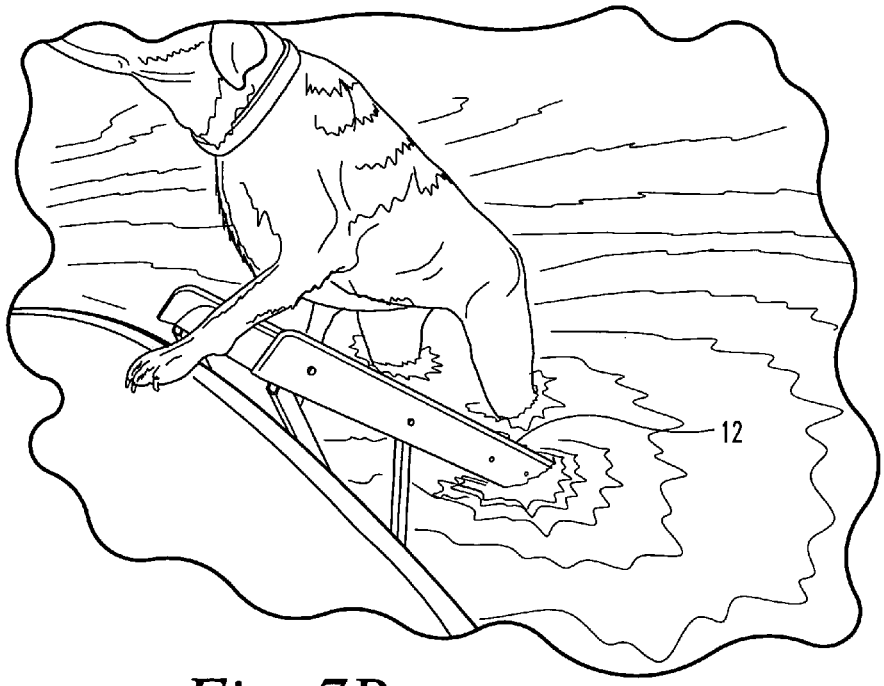
FIG. 7B is a second perspective view of a dog using the embodiment of FIG. 1 to board a boat from the water.
Figure 7C:
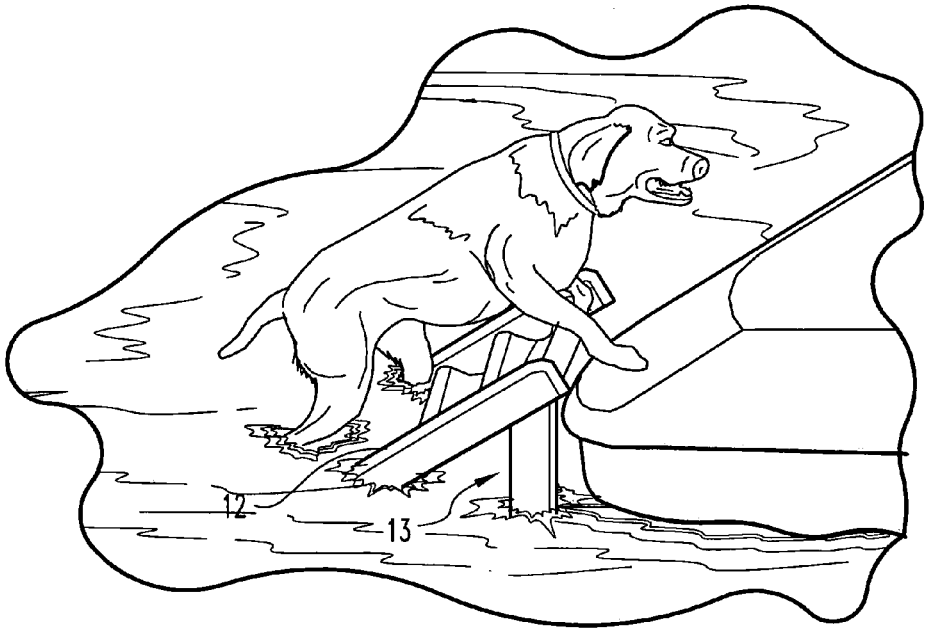
FIG. 7C is a third perspective view of a dog using the embodiment of FIG. 1 to board a boat from the water.

Once deployed, the device 10 may be used by swimming or otherwise overboard ambulatory animals as a means for (re)boarding the boat from the water under their own power. As shown in FIGS. 7A–C, an animal in the water (shown as a dog, but representative of any ambulatory animal) may board the boat by simply locating and walking up the ramp member 12 into the boat.

While the invention has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the invention are desired to be protected.

We claim:

1. A ramp for boarding swimming animals into a boat having a boat ladder, comprising in combination:

an elongated ramp member having a sidewall, a proximal end and a distal end;

a plurality of apertures formed through the sidewall;

a support assembly operationally connected to the ramp member and further comprising:

a cross member having a first and a second end and connected to the proximal end;

at least one hooked support member extending from the cross member for hookingly engaging the boat ladder;

at least one pivotable grip member pivotingly connected to the hooked support member;

a biasing member operationally connected to the pivotable grip member to urge the pivotable grip member in a first direction; and an elongated lanyard member operationally connected to the pivotable grip member; and a positioning assembly operationally connected to the ramp member and further comprising:

at least one first elongated positioning member having a first ramp-connecting end and a first boat ladder-engaging end;

an aperture-engaging protrusion extending from the first ramp-connecting end;

at least one second elongated member having a second ramp-connecting end and a first elongated positioning member connecting end; and an elongated ladder-engaging member operationally connected to the first elongated positioning member;

wherein the first elongated member connecting end is operationally connected to the at least one first elongated member;

wherein movement of the lanyard member in a direction away from the pivotable grip member urges the pivotable grip member to pivot in a second direction opposite the first direction;

wherein the cross member is pivotably connected to the elongated ramp member; and wherein the aperture-engaging protrusion is shaped to be removably engagable with the respective apertures.

2. The ramp of claim 1 wherein the elongated ramp member includes a pair of sidewalls disposed in parallel.

3. The ramp of claim 2 further comprising a plurality of stair-steps positioned between the sidewalls.

4. The ramp of claim 1 wherein the at least one hooked support member includes a first and a second hooked support member; and wherein each respective hooked support member is connected to a respective end of the cross member.

5. The ramp of claim 1 wherein the at least one first elongated positioning member includes a first and a second elongated positioning member; wherein the elongated ladder engaging member extends between the respective boat ladder engaging ends.

6. The ramp of claim 1 wherein the at least one second elongated member is pivotably connected to the at least one first elongated positioning member.

7. The ramp of claim 1 wherein the ramp member further comprises at least a pair of cavities formed therein and wherein the respective ends of the cross member interlockingly engage the respective cavities.

8. The ramp of claim 1 wherein the hooked support member may be lockingly engaged to the boat ladder by positioning the at least one pivotable grip member between the boat and the boat ladder and subsequently pivoting the pivotable grip member in the first direction.

9. An apparatus for boarding animals from the water into a boat, comprising in combination:

a plurality of spaced, generally parallel stair steps extending between a pair of elongated, generally parallel side rail members defining an elongated ladder member having a proximal end portion;

an elongated crossbeam member connected to the proximal end portion and extending between the generally parallel side rail members;

a support member extending from the crossbeam member;

a C-shaped ladder-engaging member connected to the support member;

a pivotable grip member pivotably coupled to the support member;

first biasing means operationally connected to the pivotable grip member for urging the pivotable grip member in a first direction of rotation;

second biasing means operationally connected to the pivotable grip member for urging the pivotable grip member in a second direction of rotation substantially opposite the first direction of rotation; and an elongated strut assembly extendable from the elongated ladder member.

10. The apparatus of claim 9 wherein the crossbeam is connected to the proximal end portion by fasteners.

11. The apparatus of claim 9 wherein the first biasing means includes a spring coupled between the pivotable grip member and the support member; wherein the second biasing means includes a biasing connector coupled to the pivotable grip member; and wherein movement of the biasing connector away from the pivotable grip member urges the pivotable grip member to pivot in the second direction.

12. The apparatus of claim 9 wherein the elongated ladder member further comprises a plurality of apertures formed therethrough; wherein the elongated strut assembly further comprises a plurality of pins extending therefrom; wherein each respective pin is sized to be engagable with a respective aperture; and wherein selection of which respective apertures with which to engage with the respective pins determines the disposition of the elongated ladder member relative to the boat.

13. The apparatus of claim 9 wherein the elongated strut assembly further comprises:

a first elongated strut member pivotably coupled to the elongated ladder member;

a second elongated strut member extending between the elongated ladder member and the first elongated strut member; and a boat ladder engaging member connected to the first elongated strut member;

wherein the first and second elongated strut members are removably engagable to the elongated ladder member.

14. The apparatus of claim 13 wherein the elongated ladder member further comprises a plurality of spaced engagement apertures formed therein and wherein the first and second elongated strut members further comprise respective first and second engagement pins sized to engage the respective engagement apertures.

15. The apparatus of claim 14 wherein the first elongated strut member further comprises a pair of substantially identical elongated positioning members; wherein the second elongated strut member further comprises a pair of substantially identical elongated stabilizing members; and wherein the boat ladder engaging member extends between the pair of elongated positioning members.

16. A system for boarding animals into a boat, comprising in combination:

a boat ladder having a top rung extending between a first and a second elongated ladder member and affixed to a boat;

an elongated ramp member having a proximal end portion and a central body portion;

a support member extending from the proximal end portion and engagedly abutting the top rung;

a strut extending from the central body portion and engagedly abutting a respective elongated ladder member; and a gripping assembly connected to the support member for releasably engaging the boat ladder;

wherein the gripping assembly further comprises:

at least one movable gripping member;

a first biasing member coupled to the gripping member to urge the gripping member to move in a first direction; and a second biasing member coupled to the gripping member to urge the gripping member to move in a second direction opposite the first direction;

wherein the first biasing member provides a substantially constant first biasing force;

wherein the second biasing member provides a variable second biasing force;

wherein the at least one movable gripping member may be positioned between the boat ladder and the boat such that movement of the at least one movable gripping member in the first engages the system to the boat ladder.

* * * * *